US005444891A

United States Patent [19]

Benson

[11] Patent Number: 5,444,891

[45] Date of Patent: Aug. 29, 1995

[54] EDGE GUARD FOR PAINT ROLLER

[76] Inventor: Donna M. Benson, P. O. Box 153 30 Old Coach La., Hampton Falls, N.H. 03844

[21] Appl. No.: 354,422

[22] Filed: Dec. 12, 1994

[51] Int. Cl.[6] ..... B05C 17/02

[52] U.S. Cl. ..... 15/248.2; 15/230.11; 15/246

[58] Field of Search ..... 15/230.11, 246, 248.2; 492/13, 14

[56] References Cited

U.S. PATENT DOCUMENTS

| | | | |
|---|---|---|---|
| 2,797,427 | 7/1957 | Tate | 15/230.11 |
| 2,837,757 | 6/1958 | Katanich | 15/230.11 |
| 3,109,755 | 11/1963 | Stanley | 15/246 |
| 3,112,729 | 12/1963 | Prezioso, Jr. | 15/230.11 |
| 3,213,477 | 10/1965 | Shafer | 15/248.2 |
| 3,369,269 | 2/1968 | Deck et al. | 15/248.2 |
| 3,520,628 | 7/1970 | Moceri | 15/230.11 |
| 3,538,532 | 11/1970 | Shortino et al. | 15/248.2 |
| 3,685,084 | 8/1972 | Bennett | 15/230.11 |
| 3,832,749 | 9/1974 | Hawk | 15/248.2 |
| 4,011,622 | 3/1977 | Gillum et al. | 15/248.2 |
| 4,337,002 | 6/1982 | Martucci | 15/248.2 |
| 4,528,712 | 7/1985 | Leibow | 15/230.11 |
| 4,569,099 | 2/1986 | Harding | 15/248.2 |

FOREIGN PATENT DOCUMENTS

| | | | |
|---|---|---|---|
| 1529912 | 6/1968 | France | 15/248.2 |
| 2067926 | 8/1981 | United Kingdom | 15/248.2 |

*Primary Examiner*—Mark Spisich

[57] ABSTRACT

An edge guard for paint roller wherein an elongate body having a generally C-shaped cross-sectional configuration is arranged for snap-fit over a handle portion of a paint roller handle, and the body including a first rod extending parallel to the body extending therefrom, with a second rod fixedly secured to the first rod arranged for extending along a side portion of the paint roller to provide a protective guard preventing the side portion of the roller to engage a wall surface.

3 Claims, 4 Drawing Sheets

EDGE GUARD FOR PAINT ROLLER

TECHNICAL FIELD

The field of invention relates to paint roller structure, and more particularly pertains to a new and improved edge guard for paint roller to permit a paint roller to be positioned for painting an edge portion of a surface without over-painting onto an unwanted surface.

BACKGROUND OF THE INVENTION

Various prior art structure has been available in the prior art relative to paint applicators such as indicated in the U.S. Pat. Nos. 3,520,628; 3,612,707; and 5,117,527.

The prior art has heretofore failed to provide for an edge guard structure as indicated by the instant invention arranged for retrofit relative to an existing paint roller and to this end, the instant invention presents an improved paint roller combination comprising ease of use as well as effectiveness in construction.

SUMMARY OF THE INVENTION

The edge guard for paint roller as indicated by the instant invention includes a generally elongate body having a C-shaped cross-sectional configuration arranged for a snap-fit securement to a handle shaft portion of the paint roller, such that a body end wall includes a rod extending therefrom parallel to the axis of the body, with a blade extending generally orthogonally relative to the axis of the body. The blade and the rod are mounted for flexure to permit the paint roller to be positioned to engage an adjacent surface such as a wall in painting a floor.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
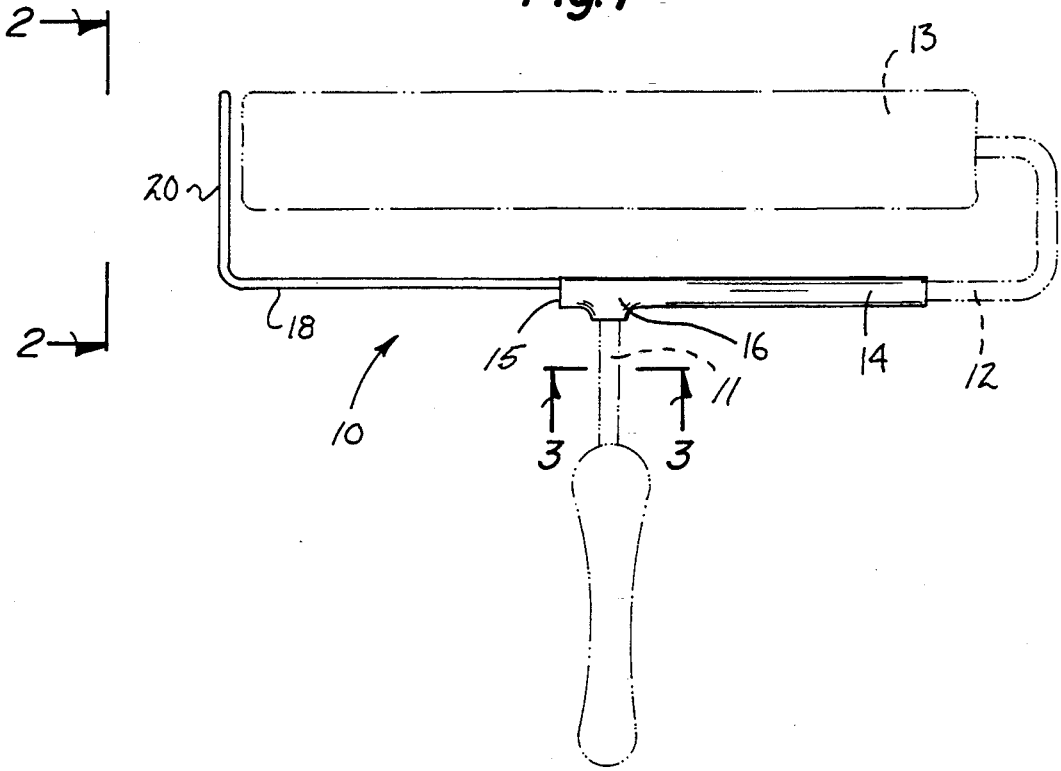
FIG. 1 is an orthographic top view of the invention.
Figure 2:
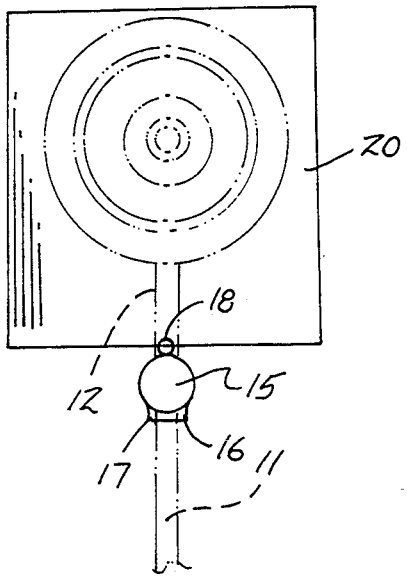
FIG. 2 is an orthographic view, taken along the lines 2—2 of FIG. 1 in the direction indicated by the arrows.
Figure 3:
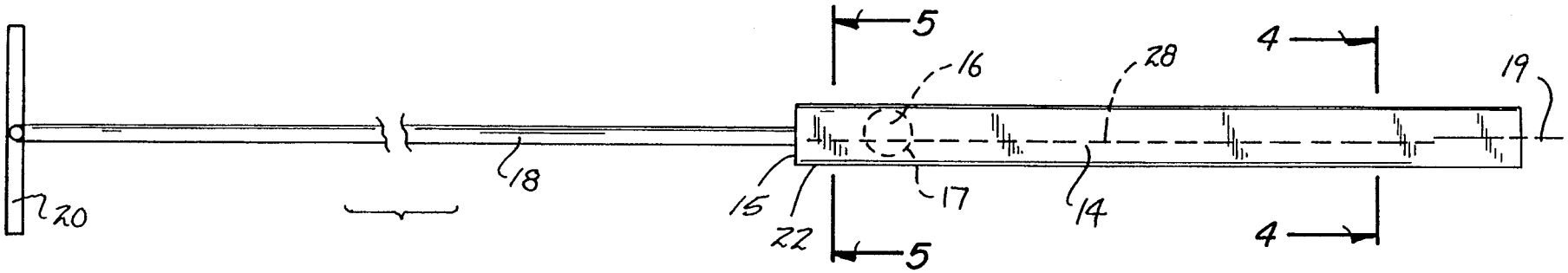
FIG. 3 is an orthographic view, taken along the lines 3—3 of FIG. 1 in the direction indicated by the arrows.
Figure 4:
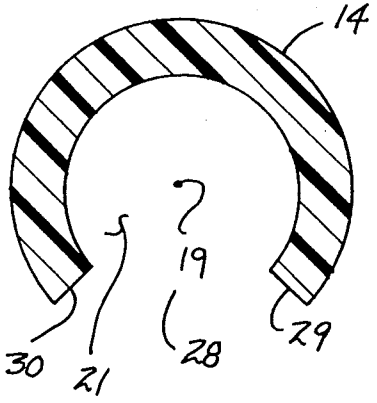
FIG. 4 is an orthographic view, taken along the lines 4—4 of FIG. 3 in the direction indicated by the arrows.
Figure 5:
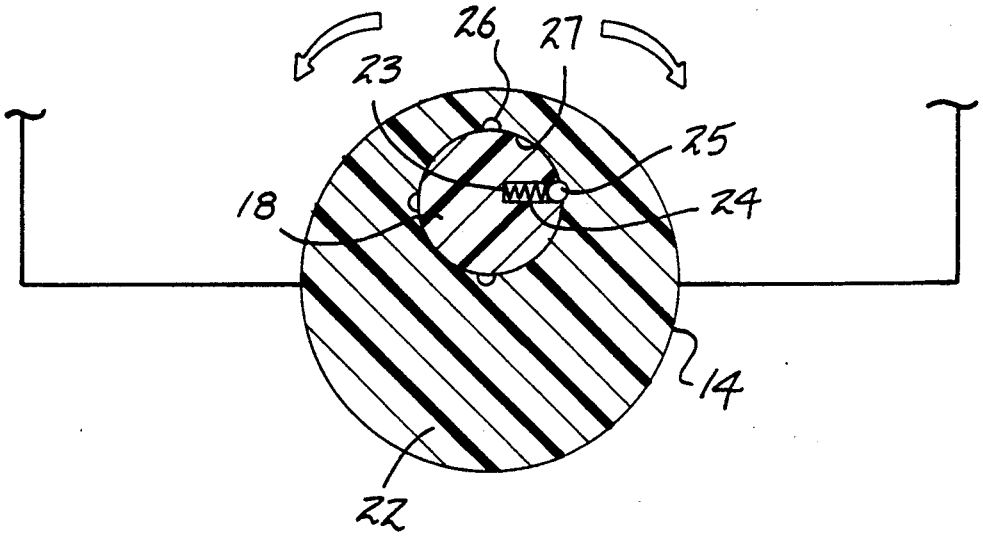
FIG. 5 is an orthographic view, taken along the lines 5—5 of FIG. 3 in the direction indicated by the arrows.

The edge guard for paint roller 10 of the invention, as indicated, is arranged for securement to a paint roller first handle shaft 11 that extends to a paint roller second handle shaft 12. A roller member 13 is rotatably mounted about the second handle shaft 12, that in turn is of a generally U-shaped configuration to accommodate the roller member 13. The invention includes an elongate, resilient body 14 of a generally C-shaped cross-sectional configuration, having a body end wall 15 of a solid body portion 22. The elongate body includes a body cavity 21 extending to the solid body portion 22, as indicated in FIG. 5. The elongate body further includes an upper semi-cylindrical tube 16 cooperating and coaxially aligned relative to a lower semi-cylindrical tube 17 mounted to the C-shaped resilient body 14 to engage the first handle shaft 11 permitting splitting of the upper and lower semi-cylindrical tubes 16 and 17 to receive the first handle shaft 11. It should also be noted that the elongate body 14 is symmetrically oriented about a body axis 19, with a rod 18 oriented parallel to the body axis and fixedly extending from the body end wall 15. A blade 20 generally obliquely, if not orthogonally, oriented relative to the rod 18 and fixedly secured to the rod 18 and is oriented such that the blade 20 is substantially orthogonally oriented relative to the body axis 19 to extend along the paint roller 13 to prevent the paint roller from engaging a surface not to be painted.

Figures 6, 7:
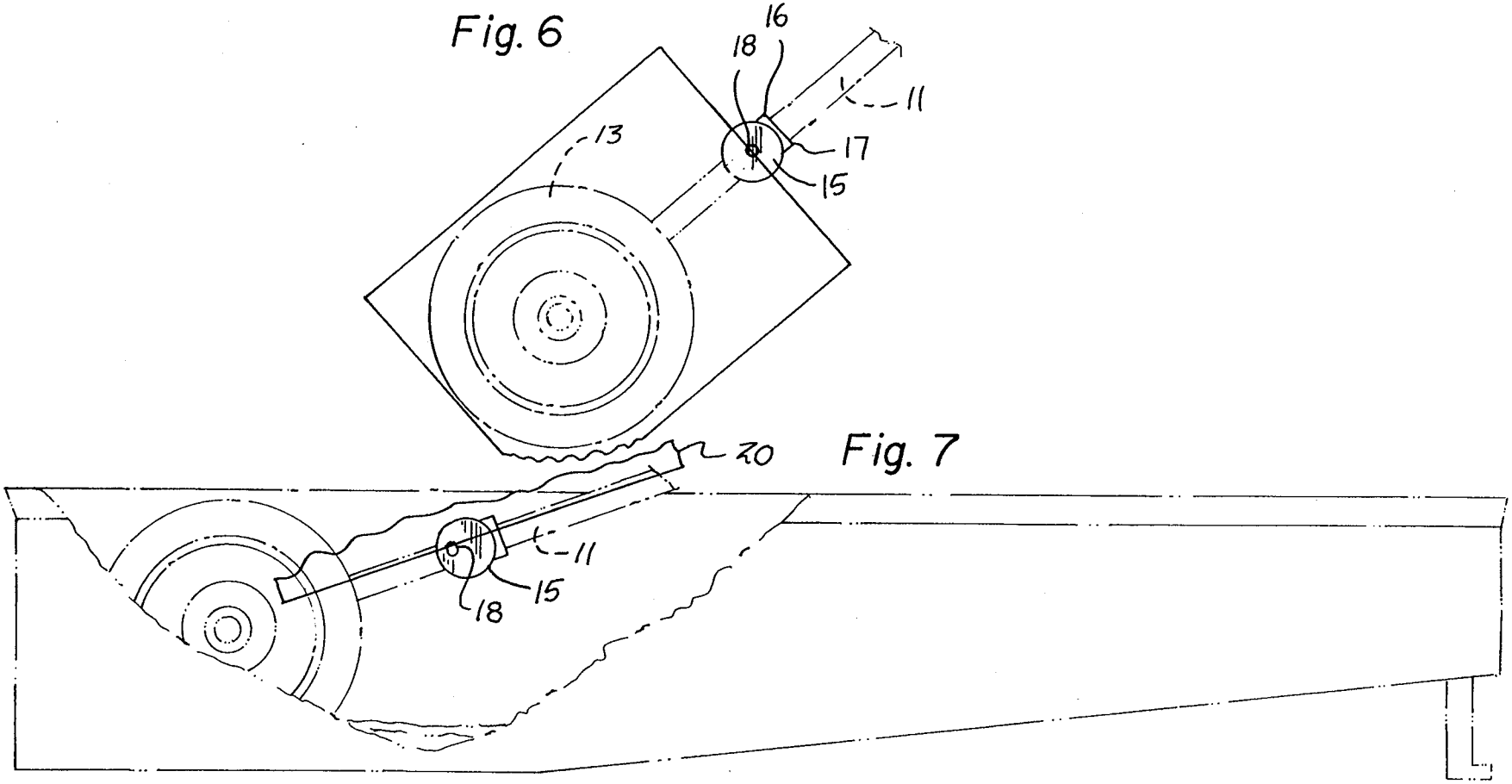
FIG. 6 is an orthographic side view of the invention employing the edge guard arranged for operative use of the paint roller.
FIG. 7 is an orthographic view of the edge guard structure relative to the elongate body for ease of directing paint onto the paint roller within a tray.

The FIG. 5 indicates that the solid body portion includes the first rod 18 rotatably mounted therewithin, such that a radial bore 23 directed into the first rod is such that a spring 24 is received within the radial bore, with a detent ball 25 mounted upon the spring, with the detent ball 25 arranged to be received within one of a plurality of body recesses 26 within the solid body portion 22 to permit the pivoting of the rods 18 and blade 20 in a manner as indicated in the FIGS. 6 and 7. It should also be noted that the rod 18 is rotatably mounted within a body bore 27 (see FIG. 5) to permit the pivoting of the rod 18 and blade 20, in a manner as indicated in the FIGS. 6 and 7, such that upon application of paint to the paint roller within the paint tray in a conventional manner, as indicated in FIG. 7, the rod 18 may be pivoted for greater ease of manipulation of the rod 18 and attached blade 20. It should also be understood that the rotative nature of the rod 18 and blade 20 need not be employed by the instant invention and to this end, the first rod 18 would be merely fixedly secured relative to the solid body portion 22 in a parallel orientation relative to the axis 19.

The elongate body is formed with a body upper edge 30 and a body lower edge 29 relative to a body gap 28, wherein the upper semi-cylindrical tube extends from the upper edge and the lower semi-cylindrical tube extends from the lower edge to permit encompassing of the first handle shaft when secured to the paint roller assembly. In this manner, the gap 28 may be spread to permit mounting of the elongate body over the first and second handle shafts, whereupon release permits the shape retentive material forming the elongate body resumes its original shape to secure the upper and lower semi-cylindrical tubes 16 and 17 about the first handle shaft for proper alignment and mounting of the organization relative to the paint roller assembly.

It should be understood that as described the organization 10, and specifically the various components thereof, such as the resilient body 14, the rod 18, the blade 20 are of sufficient flexible construction that the paint roller 13 is permitted to engage a surface to be painted, such that when pressure is applied to the blade 20, it flexes along with the rod 18 and the elongate body 14 to permit engaging the roller 13 onto the surface, to be painted.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. An edge guard for a paint roller having a first handle shaft and a second handle shaft, with a roller member rotatably mounted to the second handle shaft, wherein the edge guard comprises, an elongate, resilient body formed of shape retentive material, having an elongate body cavity, the body having a body first end spaced from a body second end, the body first end including a body end wall, with a solid body portion extending into the body from the body end wall, with the body arranged for securement to the first handle shaft, with a rod extending from the body end wall, with the body symmetrically oriented about its longitudinal body axis, and the rod parallel to the body axis, with the rod having a blade secured to an end thereof spaced from the body end wall, with the blade oriented obliquely relative to the axis.

2. An edge guard as set forth in claim 1 wherein the elongate body has a gap extending through the body in communication with the body cavity, with the body having an upper semi-cylindrical tube coaxially aligned relative to a lower semi-cylindrical tube, with the upper semi-cylindrical tube formed to a body upper edge, and the lower semi-cylindrical tube formed to a body lower edge.

3. An edge guard as set forth in claim 2 wherein the solid body portion includes a body bore receiving the rod rotatably therewithin, with the rod having a radial bore directed into the rod relative to the body bore, and the radial bore having a spring contained therewithin, and a detent ball, wherein the body bore includes a plurality of body recesses to selectively receive the detent ball within one of said recesses to permit pivoting of the rod and the blade relative to the body.

* * * * *